US009920555B2

(12) United States Patent
Brickner et al.

(10) Patent No.: US 9,920,555 B2
(45) Date of Patent: Mar. 20, 2018

(54) LOCK FOR A MOTOR VEHICLE

(71) Applicants: Robert L. Brickner, Berkley, MI (US); Robert S. Pettengill, Farmington, MI (US)

(72) Inventors: Robert L. Brickner, Berkley, MI (US); Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 307 days.

(21) Appl. No.: 13/744,934

(22) Filed: Jan. 18, 2013

(65) Prior Publication Data

US 2014/0203575 A1 Jul. 24, 2014

(51) Int. Cl.

| | |
|---|---|
| ***E05B 15/02*** | (2006.01) |
| ***E05B 77/12*** | (2014.01) |
| ***E05B 77/06*** | (2014.01) |
| *E05C 3/02* | (2006.01) |
| *E05C 3/04* | (2006.01) |
| *E05C 3/06* | (2006.01) |
| *E05C 3/16* | (2006.01) |
| *E05B 85/26* | (2014.01) |

(52) U.S. Cl.

CPC ..... *E05B 77/12* (2013.01); *E05B 77/06* (2013.01); *E05B 85/26* (2013.01); *Y10T 292/702* (2015.04)

(58) Field of Classification Search

CPC ..... Y10T 292/702; E05B 77/02; E05B 77/04; E05B 77/06; E05B 77/12

USPC ..... 292/200, 201, 216, 194, 195, 210, 198, 292/DIG. 23, 217, DIG. 22

See application file for complete search history.

(56) References Cited

U.S. PATENT DOCUMENTS

| | | | | |
|---|---|---|---|---|
| 4,518,180 A * | 5/1985 | Kleefeldt | ..... | E05B 81/06 292/201 |
| 4,995,654 A * | 2/1991 | Nishigami | ..... | E05B 77/12 292/216 |
| 5,188,406 A * | 2/1993 | Sterzenbach | ..... | E05B 85/26 292/210 |
| 5,564,761 A * | 10/1996 | Mizuki | ..... | E05B 81/20 292/201 |

(Continued)

FOREIGN PATENT DOCUMENTS

| | | |
|---|---|---|
| DE | 102011010797 A1 | 8/2012 |
| DE | 102011010815 A1 | 8/2012 |

(Continued)

*Primary Examiner* — Kristina Fulton
*Assistant Examiner* — Faria Ahmad
(74) *Attorney, Agent, or Firm* — Renner, Otto, Boisselle & Sklar, LLP

(57) ABSTRACT

A lock with a locking mechanism includes a rotary catch and a pawl for engaging the rotary catch, and a releasing lever for opening or releasing the locking mechanism. The lock may include a blocking lever capable of blocking the pawl if the latter is located in its catching position. If the releasing lever is actuated, the pawl or the blocking lever is thereby moved out of its blocking position if the releasing lever is not excessively accelerated. If excessively large accelerations of the releasing lever occur, as can be caused by a crash, then an arresting device of the lock prevents the releasing lever from being able to move the pawl or the blocking lever out of its blocking or latching position, respectively. The lock is therefore incapable of opening if the releasing lever is accelerated in the event of a crash.

11 Claims, 2 Drawing Sheets

(56) References Cited

U.S. PATENT DOCUMENTS 5,622,396 A * 4/1997 Neumann ..... E05B 83/36 292/202
5,634,677 A * 6/1997 Buscher et al. ..... 292/216
5,653,484 A * 8/1997 Brackmann ..... E05B 77/28 292/216
5,865,481 A 2/1999 Buschmann
5,921,595 A * 7/1999 Brackmann ..... E05B 83/36 292/201
5,931,034 A * 8/1999 Fisher ..... E05B 81/06 292/201
5,961,163 A * 10/1999 Brackmann ..... E05B 81/06 292/201
5,979,951 A * 11/1999 Shimura ..... E05B 85/26 292/216
6,059,327 A * 5/2000 Yoshikuwa ..... E05B 83/16 292/216
6,076,868 A * 6/2000 Roger, Jr. ..... E05B 81/14 292/199
6,109,079 A * 8/2000 Ikeda ..... E05B 81/06 292/201
6,126,212 A * 10/2000 Fujihara ..... E05B 85/243 292/216
6,135,514 A * 10/2000 Kowalewski ..... E05B 83/16 292/216
6,142,540 A * 11/2000 Girard ..... E05B 81/90 292/169.11
6,148,651 A * 11/2000 Roncin ..... E05B 77/265 292/201
6,279,361 B1 * 8/2001 Baukholt ..... E05B 81/14 292/201
6,338,508 B1 * 1/2002 Kleefeldt ..... E05B 81/06 292/201
6,343,817 B1 * 2/2002 Watanabe ..... E05B 77/30 292/201
6,364,379 B1 * 4/2002 Roberts ..... E05B 83/16 292/216
6,367,296 B1 * 4/2002 Dupont ..... E05B 81/16 292/201
6,371,536 B1 * 4/2002 Koerwer ..... E05B 81/14 292/201
6,371,538 B1 * 4/2002 Inoue ..... E05B 77/30 292/201
6,382,687 B1 * 5/2002 Gruhn ..... E05B 81/14 292/201
6,406,073 B1 * 6/2002 Watanabe ..... E05B 77/265 292/216
6,435,573 B1 * 8/2002 Szablewski ..... E05B 81/14 292/201
6,540,272 B2 * 4/2003 Spurr ..... E05B 85/243 292/216
6,679,531 B2 * 1/2004 Rogers, Jr. ..... E05B 83/16 292/216
6,791,688 B2 9/2004 Lai et al.
6,824,177 B1 * 11/2004 Nass et al. ..... 292/216
6,932,393 B2 * 8/2005 Erices ..... E05B 81/06 292/216
6,991,272 B2 1/2006 Kalsi
7,475,922 B2 * 1/2009 Ottino ..... E05B 85/26 292/216
7,568,740 B2 * 8/2009 Brose ..... E05B 81/06 292/201
7,607,702 B2 * 10/2009 Pereverzev ..... E05B 77/06 292/201
7,926,858 B2 * 4/2011 Otsuka ..... 292/216
8,056,944 B2 * 11/2011 Jankowski ..... E05B 77/06 292/201
8,303,004 B2 * 11/2012 Lee ..... E05B 77/06 292/216
8,353,542 B2 * 1/2013 Cumbo ..... E05B 77/06 292/196
8,840,154 B2 * 9/2014 Wilms ..... E05B 81/06 292/201
9,151,090 B2 * 10/2015 Beck ..... E05B 77/06
9,410,345 B2 * 8/2016 Uehara ..... E05B 77/06
2001/0005080 A1 * 6/2001 Inoue ..... E05B 77/24 292/216
2001/0010427 A1 * 8/2001 Roos ..... E05B 81/14 292/201
2001/0024040 A1 * 9/2001 Spurr ..... 292/216
2002/0167178 A1 * 11/2002 Spurr ..... E05B 77/02 292/201
2003/0234544 A1 * 12/2003 Jankowski ..... E05B 77/06 292/220
2005/0134054 A1 * 6/2005 Stefanic ..... E05B 17/0004 292/201
2005/0140146 A1 * 6/2005 Spurr ..... E05B 17/007 292/216
2006/0208504 A1 * 9/2006 Kachouh ..... B60N 2/4435 292/216
2006/0226661 A1 * 10/2006 Moore ..... E05B 81/20 292/216
2006/0261602 A1 * 11/2006 Jankowski ..... E05B 77/12 292/216
2008/0217928 A1 * 9/2008 Spurr ..... E05B 81/20 292/198
2008/0224482 A1 * 9/2008 Cumbo ..... E05B 77/02 292/216
2009/0322105 A1 12/2009 Lee et al.
2010/0013246 A1 * 1/2010 Tomaszewski ..... E05B 85/01 292/216
2010/0052336 A1 3/2010 Bendel et al.
2011/0187132 A1 * 8/2011 Scholz ..... E05B 81/20 292/226
2011/0210565 A1 9/2011 Scholz et al.
2012/0068479 A1 * 3/2012 Bendel ..... E05B 81/20 292/200
2012/0110920 A1 * 5/2012 Takagi ..... E05B 77/06 49/503
2014/0001774 A1 1/2014 Bendel et al.
2014/0035295 A1 2/2014 Bendel et al.
2014/0049056 A1 * 2/2014 Scholz ..... E05B 81/14 292/200
2014/0132008 A1 * 5/2014 Bendel ..... E05B 77/06 292/92
2014/0175813 A1 * 6/2014 Margheritti ..... E05B 81/06 292/201
2014/0203575 A1 7/2014 Brickner et al.

FOREIGN PATENT DOCUMENTS

DE 102011010816 A1 8/2012
DE 102013203808 A1 9/2014
EP 1 518 983 A2 3/2005

* cited by examiner

LOCK FOR A MOTOR VEHICLE

BACKGROUND OF THE INVENTION

1. Field of the Invention

The invention relates to a lock for a motor vehicle.

2. Description of the Related State of the Art

A lock for a motor vehicle comprises a locking mechanism with a rotatably mounted rotary catch for receiving a locking bolt also referred to as a striker. The locking mechanism moreover comprises a pawl with which the rotary catch can be engaged for retaining the locking bolt.

The rotary catch of a motor vehicle lock usually comprises a fork-shaped inlet slot (also referred to as inlet opening) which is formed by the load arm and the rotary catching arm and which the locking bolt (also known as a striker) of a vehicle door or hatch, e.g. a hood or a trunk lid, enters when the door or hatch is closed. The locking bolt or striker then turns the rotary catch from an opened position in the direction of the closed position until the pawl engages the rotary catch. This position is referred to as the catching position. The locking bolt then cannot leave the inlet slot of the rotary catch.

Furthermore, a lock can comprise a blocking lever capable of blocking the pawl in its catching position. The blocking lever has to be pivoted or turned out of its blocking position in order for the pawl to be able to leave its catching position for opening the locking mechanism.

There are locks as known from US 2010 052 336 A1 in which the rotary catch is capable of introducing an opening moment into the pawl if the latter is in its catching position. Such a lock requires a blocking lever in order to be able to engage the locking mechanism. Such locks can be opened with little effort.

There are motor vehicle locks with two catching positions, i.e. a preliminary catching position and a main catching position. The preliminary catching position serves for rotary catching the respective door or hatch when the latter does not reach the main catching position during the closing process. If, starting from the preliminary catching position, the rotary catch is turned further correspondingly, it will finally reach the main catching position.

As a matter of principle, a lock comprises a releasing lever which is actuated in order to open or disengage a locking mechanism. Such a releasing lever is typically connected to a handle of a door or hatch. If the handle is actuated, the releasing lever is actuated, or pivoted, in order to disengage the locking mechanism and thus open the lock.

In the event of a crash, the handle may be actuated inadvertently, which would lead to the locking mechanism being opened. It should be ensured that such a lock does not open inadvertently in such a case.

In order to ensure that a lock does not open inadvertently in the event of a crash, a lock with a locking mechanism is provided according to document EP 1518983A2, which comprises at least one actuating lever for releasing or opening the locking mechanism, i.e. a releasing lever. The lock moreover comprises a blocking lever which blocks the actuating lever during predetermined vehicle accelerations.

In the event of a crash, particularly large accelerations occur, compared with a usual opening process. If the actuating lever blocks only at large vehicle accelerations, such as occur in the event of a crash, an unintentional opening of the locking mechanism in the case of a crash can be prevented. In the case of a usual actuation of the door handle, the actuating lever is not blocked for lack of a great acceleration in order to then enable the lock to be opened.

SUMMARY OF THE INVENTION

In view of the above-described problems, the invention provides in one aspect a lock in which an inadvertent opening is prevented in the event of a crash.

In order to accomplish the object, in accordance with one embodiment of the invention, a lock with a locking mechanism is provided which comprises a rotary catch and a pawl for engaging the rotary catch. Furthermore, the lock may comprise a blocking lever capable of blocking the pawl if the latter is located in its catching position. Moreover, a releasing lever for opening or releasing the locking mechanism is provided. If the releasing lever is actuated, the pawl or the blocking lever is thereby moved out of its blocking position if the releasing lever is not excessively accelerated. If excessively large accelerations of the releasing lever occur, as can be caused by a crash, then an arresting device of the lock prevents the releasing lever from being able to move the pawl or the blocking lever out of its blocking or latching position, respectively. The lock is therefore incapable of opening if the releasing lever is accelerated in the event of a crash.

In one embodiment, the arresting device comprises an inertia lever and a blocking lever. The inertia lever and the blocking lever are interconnected in such a way that the inertia lever is moved together with the blocking lever by the releasing lever only when the releasing lever is accelerated in the usual manner, as is the case when the door handle is actuated in the usual way for example by a driver of the vehicle. In such a case, the joint movement of the inertia lever and the blocking lever takes place in such a way that the blocking lever is incapable of preventing the locking mechanism from being opened. If the releasing lever is greatly accelerated, as this is possible in the event of a crash, then, due to the inertia of the inertia lever, only the blocking lever is moved, namely into a position which blocks further pivoting of the releasing lever in such a way that the locking mechanism is prevented from being opened.

In one embodiment of the invention, the arresting device comprises a spring which interconnects the inertia lever and the blocking lever in such a way that the inertia lever is moved together with the blocking lever by the releasing lever only when the releasing lever is accelerated in the usual manner. In a technically simple manner, this prevents a lock from being able to open unintentionally in the event of a crash. Acceleration in a usual manner means that there is no excessively large accelerations of the releasing lever (as a rule due to a crash).

In one embodiment of the invention, one leg of the spring is connected to the inertia lever. Such a connection is provided in particular if the leg of the spring rests against a contour of the inertia lever, preferably in a biased state. The contour may be provided by a projection or gap of the inertia lever. Another leg of the spring is connected to the blocking lever. Such a connection is provided in particular when the leg of the spring rests, preferably biased, against a contour of the blocking lever. A projection or a gap of the blocking lever may provide the contour. In the case of lower accelerations, the spring acts like a rigid connection between the blocking lever and the inertia lever. At lower accelerations, the blocking lever and the inertia lever are therefore moved together by an actuation of the releasing lever for opening the locking mechanism. Actuation of the releasing lever takes place by actuating a handle or grip of the corresponding door or flap.

In the case of a large acceleration, the spring, due to the inertia of the inertia lever, is deformed in such a way that only or at least mainly the blocking lever is moved, but not or at least nearly not the inertia lever. In particular, the spring is biased further in the case of a correspondingly large acceleration. If the blocking lever is moved independently of the inertia lever, the blocking lever then enters its arresting position. In the arresting position, the releasing lever is prevented from being able to be twisted further in such a way that the locking mechanism is opened thereby.

In one embodiment, the blocking lever comprises a lug which can be moved by the releasing lever for moving the blocking lever. If the releasing lever is actuated, the lug, and thus the blocking lever, are moved.

In one preferred embodiment of the invention, the lug of the blocking lever provides the above mentioned contour for the spring or a leg of the spring.

Preferably, the mass of the inertia lever is at least two, three, four or more times larger times larger than the mass of the blocking lever so as to reliably cause the inertia lever to be moved only at low accelerations of the releasing lever.

In one embodiment of the invention, a rotatably mounted safety lever rests against a contour of the inertia lever in a biased manner so as to reliably cause the inertia lever to be moved only at low accelerations of the releasing lever.

In one embodiment of the invention, the lock comprises an arresting profile rigidly or rotatably connected to a lock casing of the lock. The arresting profile serves for arresting the blocking lever if the releasing lever is excessively accelerated. If the blocking lever is arrested by the arresting profile and is thus located in its arresting position, the releasing lever cannot be twisted further in such a way that the locking mechanism is opened thereby.

In one embodiment of the invention, the rotatably mounted safety lever comprises the arresting profile in order to reduce the number of parts.

In one embodiment, the lock may comprise a blocking lever which may block the pawl in its arresting position. In this embodiment, a release lever may catch a lug of the blocking lever in order to remove the blocking lever from its blocking position.

In one embodiment, a release lever may act as a second pawl in order to engage the rotary catch.

BRIEF DESCRIPTION OF THE DRAWINGS

The invention is described hereinafter with reference to accompanying drawings, in which.

DETAILED DESCRIPTION OF THE INVENTION

Figure 1:
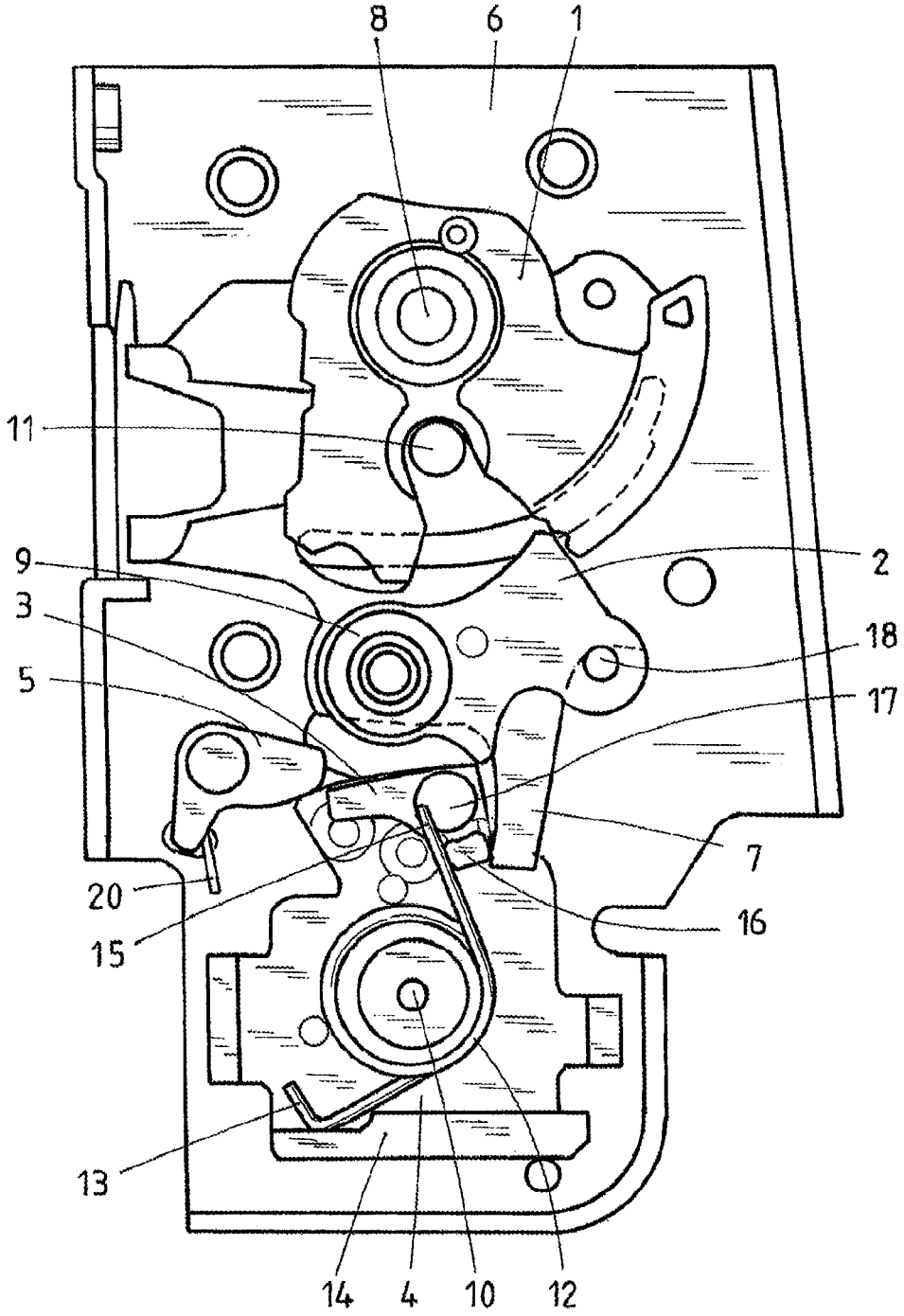
FIG. 1 is a schematic side view of a locking mechanism in accordance with an exemplary embodiment of the invention.

As shown in FIG. 1, the locking mechanism of a lock comprises a rotary catch 1, a pawl 2, a blocking lever 3, an inertia lever 4 below the blocking lever 3 and a safety lever 5. Rotary catch 1, pawl 2, inertia lever 4 and safety lever 5 are rotatably mounted on a metal plate 6. In addition, there is a releasing lever. FIG. 1 shows a section 7 of the releasing lever. The release lever 7 can be placed above the pawl 2 and can be rotatably mounted on axis 9.

Rotary catch 1 may rotate around its axis 8. Pawl 2 may rotate around its axis 9. Inertia lever 4 may rotate around its axis 10. The weight of the inertia lever 4 is much higher than the weight of the blocking lever 3, at least two, three, four or more times.

As shown in FIG. 1, the pawl 2 blocks a clockwise rotation of the rotary catch 1. Therefore, the pawl 2 is in its catching position. In order to unlock the locking mechanism, it is necessary to rotate the pawl 2 clockwise. When the pawl 2 has leaved its catching position, the rotary catch 1 can rotate clockwise in the direction of its opened position. When the rotary catch 1 arrives at its opened position, the lock holder 11 of a vehicle door or vehicle flap can leave the locking mechanism. It is then possible to open the corresponding door or flap.

Figure 2:
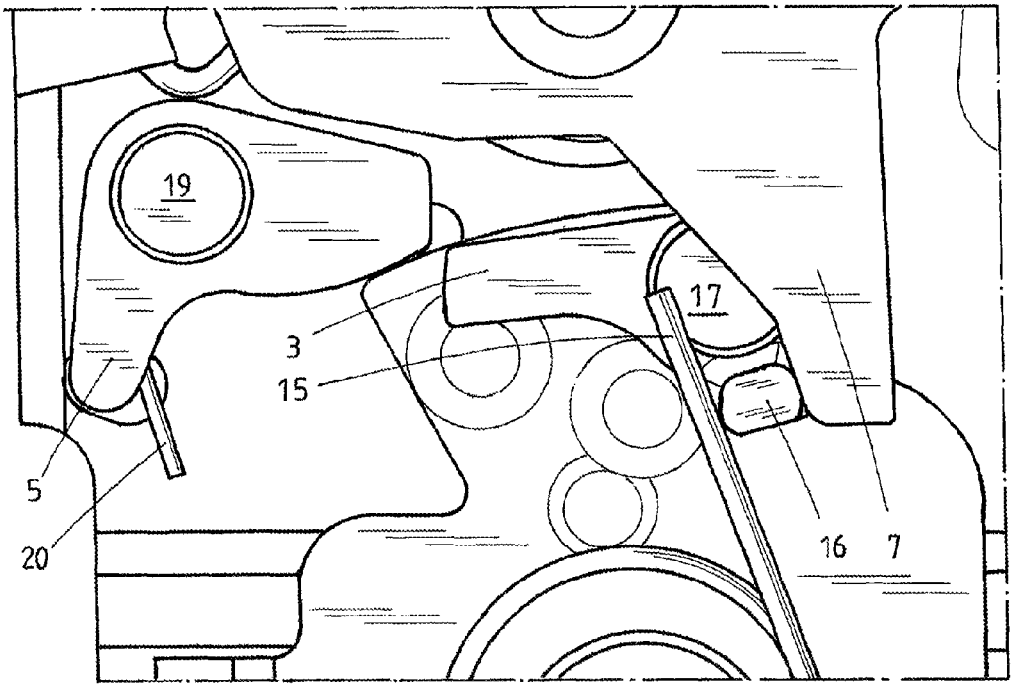
FIG. 2 is a first detailed view of the arresting device in accordance with the exemplary embodiment of the invention.

The blocking lever 3 is rotatably mounted on the inertia lever 4 adjacent to a lever arm of the releasing lever 7. Further, blocking lever 3 and inertia lever 4 are interconnected by a biased spring 12. A first leg 13 of the spring 12 rests against a projection 14 of the inertia lever 4 in a biased manner. The second leg 15 of the spring 12 rests against a projection 16 of the blocking lever in a biased manner as shown in greater detail in the FIGS. 2 and 3.

Projection 16 acts in addition as a lug. The above mentioned lever arm of the releasing lever 7 can catch the lug 16 in order to move the blocking lever 3 to the left. The blocking lever 3 may rotate around its axis 17 or together with the inertia lever 4 around the axis 10.

Activation by a driver or a further person of a corresponding grip of a vehicle connected to the locking mechanism, such as by a Bowden cable or other known means, results in rotating the releasing lever 2 in a clockwise manner. In such a case, the corresponding arm of the releasing lever moves the blocking lever 3 to the left. When the acceleration is low, the spring 12 acts as a rigid connection between the inertia lever 4 and the blocking lever 3. For this reason, movement of the blocking lever 3 to the left results in rotating the inertia lever 4 together with the blocking lever 3 in a counterclockwise manner around the axis 10. The releasing lever 7 catches a lug respectively a projection 18 of the pawl 2 in order to remove the pawl from its catching position. At the end, it is possible to open the corresponding door or flap.

During motor vehicle collisions, parts of the door handle or other vehicle components may accelerate and cause unwanted actuation of the grip resulting in a strong acceleration of the releasing lever 7. A strong acceleration of the releasing lever 7 results in a strong acceleration of the blocking pawl 3 to the left. In this case, the spring 12 does not act as a rigid connection between the blocking lever 3 and the inertia lever 4 due to the high weight and the resulting inertia of the inertia lever 4 and/or due to a friction force between the inertia lever 4 and the safety lever 5 since the safety lever 5 rests in a biased manner at a contour of the inertia lever 4. As a result, the inertia lever 4 does not rotate around its axis 10. Instead of that, the blocking lever 3 rotates in a clockwise manner in the direction of the position as shown in FIG. 3 around its axis 17.

Figure 3:
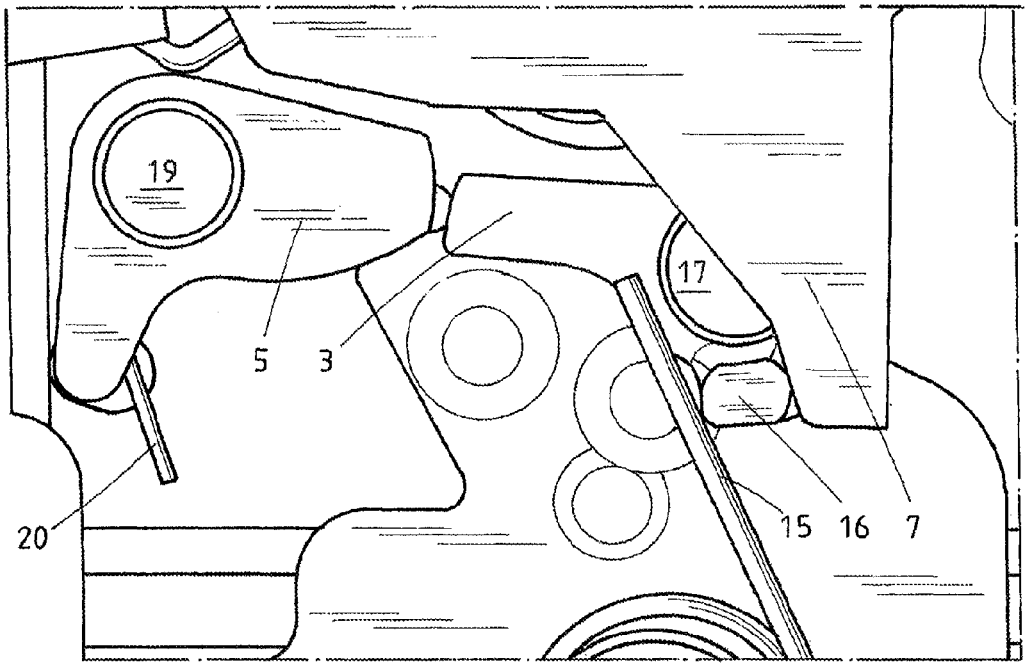
FIG. 3 is a second detailed view of the arresting device in accordance with the exemplary embodiment of the invention.

When the blocking lever arrived at the position as shown in FIG. 3, the safety lever 5 may block a movement of the blocking lever 3 to the left. In such a case, a further clockwise rotation of the release lever 7 is not possible. As a result, the pawl 2 will rest in its catching position as shown in FIG. 1.

The movement of the inertia lever 4 back to its starting position as shown in FIG. 1 can be achieved by gravity and/or by a further spring.

The rotatably mounted safety leaver is rotatable around its axis 19. Due to a spring 20, the safety lever rests against a contour of the inertia lever in a biased manner.

What is claimed is:

1. Lock for a motor vehicle comprising a locking mechanism with a rotatably mounted rotary catch for receiving a locking bolt, a pawl with which the rotary catch can be engaged for retaining the locking bolt, a releasing lever for disengaging the locking mechanism;

and an arresting device which is configured such that in response to a first accelerating force applied to the releasing lever, the arresting device permits the releasing lever to disengage the locking mechanism, and in response to a second accelerating force that is excessively large relative to the first accelerating force, the arresting device prevents the releasing lever from being able to disengage the locking mechanism;

wherein the arresting device comprises an inertia lever, a blocking lever that blocks the pawl for retaining the locking bolt, and a spring that directly interconnects the inertia lever and the blocking lever, and wherein the inertia lever, the blocking lever, and the spring are interconnected in such a way that the spring acts as a rigid connection between the inertia lever and the blocking lever whereby rotation of the blocking lever by the releasing lever rotates the inertia lever in response to the first accelerating force, and the spring does not act as a rigid connection between the blocking lever and the inertia lever by acceleration of the releasing lever in response to the second accelerating force such that the blocking lever rotates while the inertia lever does not rotate.

2. The lock of claim 1, wherein one leg of the spring rests against the inertia lever and the other leg of the spring rests against the blocking lever.

3. The lock of claim 2, wherein the blocking lever is rotatably mounted on the inertia lever.

4. The lock of claim 3, wherein the blocking lever comprises a lug which can be moved by the releasing lever for moving the blocking lever.

5. The lock of claim 4, wherein a leg of the spring rests against a contour of the lug in a biased manner.

6. The lock of claim 1, wherein the mass of the inertia lever is several times larger than the mass of the blocking lever to enable lack of the rigid connection between the blocking lever and the inertia lever in response to the second accelerating force.

7. The lock of claim 1, comprising an arresting profile connected to a lock casing or a plate of the lock.

8. The lock of claim 7, wherein a rotatably mounted safety lever arresting profile comprises the arresting profile and rests against a contour of the inertia lever in a biased manner.

9. The lock of claim 1, wherein the blocking lever is capable of blocking the pawl in a catching position of the lock.

10. The lock of claim 9, wherein the rotary catch is capable of introducing an opening moment into the pawl if the pawl is in its catching position.

11. The lock of claim 1, wherein the arresting device further comprises a safety lever, and in response to the second accelerating force the blocking lever moves until it reaches the safety lever such that the safety lever acts as a stop that limits movement of the blocking lever sufficiently to preclude a further rotation of the release lever in response to the second accelerating force.

* * * * *